US006568926B1

(12) United States Patent
Mount

(10) Patent No.: US 6,568,926 B1
(45) Date of Patent: May 27, 2003

(54) FLUID METERING PUMP

(75) Inventor: Mason B. Mount, Mansfield, OH (US)

(73) Assignee: The Gorman-Rupp Company, Mansfield, OH (US)

( * ) Notice: Subject to any disclaimer, the term of this patent is extended or adjusted under 35 U.S.C. 154(b) by 0 days.

(21) Appl. No.: 10/003,628

(22) Filed: Oct. 31, 2001

(51) Int. Cl.[7] ..... F04B 39/10; F04B 53/10

(52) U.S. Cl. ..... 417/568; 417/413.1; 417/395; 60/453; 92/79

(58) Field of Search ..... 417/388, 389, 417/390, 395, 568, 413.1; 60/453; 92/79, 98 R, 101

(56) References Cited

U.S. PATENT DOCUMENTS

| | | | | | |
|---|---|---|---|---|---|
| 3,672,791 | A | * | 6/1972 | Zimmerly | 417/205 |
| 4,507,062 | A | * | 3/1985 | Wally | 417/413 |
| 5,441,392 | A | * | 8/1995 | Lundback | 417/479 |
| 5,782,617 | A | * | 7/1998 | Habla | 417/395 |
| 5,934,886 | A | * | 8/1999 | Bushnell | 417/395 |
| 6,086,340 | A | * | 7/2000 | Edwards et al. | 417/440 |
| 6,162,028 | A | * | 12/2000 | Rembold | 417/413.1 |
| 6,168,390 | B1 | * | 1/2001 | Hunklinger et al. | 417/299 |

FOREIGN PATENT DOCUMENTS

JP 2000-87861 * 3/2000

OTHER PUBLICATIONS

Drawing No. EX362–355 of Gorman–Rupp Industries, Mansfield, Ohio, dated Jul. 9, 1999.

* cited by examiner

*Primary Examiner*—Charles G. Freay
*Assistant Examiner*—Han L. Liu
(74) *Attorney, Agent, or Firm*—Renner, Kenner, Greive, Bobak, Taylor & Weber

(57) ABSTRACT

A pump (10) includes a chamber (14) communicating with a fluid inlet (12) and a fluid outlet (13) above the centerline thereof to minimize dead air space where air bubbles might form. A connector (21) having a bend or elbow (26) is formed at the fluid inlet (12). Upon actuation of a solenoid (37), a plunger (39) carrying a diaphragm (42) is moved to draw fluid around the elbow (26), through a valve (19) positioned at the fluid inlet (12), through the chamber (14), and out of the pump (10) through a valve (30) positioned at the fluid outlet (13). The energy of the fluid which might otherwise create a water hammer effect is absorbed by the elbow (26) prior to reaching the pump (10).

14 Claims, 2 Drawing Sheets

FLUID METERING PUMP

TECHNICAL FIELD

This invention relates to a pump which can repeatedly discharge a precise amount of fluid. More particularly, this invention relates to such a pump with improved, repeated accuracy in that deleterious water hammer is eliminated and internal dead air space is minimized.

BACKGROUND ART

Fluid metering pumps are well known in the art. In these types of pumps, it is desirable that a precise amount of fluid be repeatedly discharged from the pump. Repeated, accurate operation of the pump can be critical in many applications, such as operation in the medical field.

A typical prior-art metering pump is piston diaphragm operated and includes vertically-spaced inlet and outlet valve assemblies with a pump chamber therebetween. An actuating assembly is normally positioned laterally of the pump body and communicates with the pump chamber through a diagonally oriented passageway. The actuating assembly includes a solenoid-actuated piston or plunger which carries a diaphragm. When the solenoid is actuated, the piston moves the diaphragm to draw fluid in through the lower inlet valve and into the pump chamber and the diagonal passageway. Then, when the solenoid is disengaged, a return spring pushes the diaphragm downwardly to force fluid out of the diagonal passageway and the pump chamber, and out through the discharge valve located vertically above the inlet valve. The volume of the fluid to be pumped with each stroke of the plunger can be controlled by regulating the extent of the stroke of the plunger.

These types of pumps do not always provide repeated, accurate fluid discharge for at least two reasons. First, air pockets of an inconsistent and/or unpredictable size will tend to form around the diaphragm of these prior-art pumps. As such, due to the inconsistencies of the compressibility of the air, consistency or repeatability of the pumped fluid output is not readily obtainable.

The other major problem which results in inconsistencies of the fluid output of these prior-art pumps is the existence of the water hammer phenomena. That is, when the plunger strokes to allow the diaphragm to pull fluid in through the inlet, all of the fluid in the conduit between the inlet and the source of supply is set in motion. As a result, when the valves want to close at the end of a stroke, the momentum of the moving fluid will continue to push on the inlet valve to potentially expel an undesired and potentially unmeasurable amount of fluid through the outlet valve.

Thus, the need exists for a pump which can repeatedly meter the desired amount of fluid to be discharged therefrom.

DISCLOSURE OF THE INVENTION

It is thus an object of the present invention to provide a pump which delivers the same amount of fluid upon each actuation thereof.

It is another object of the present invention to provide a pump, as above, which minimizes any dead air space.

It is a further object of the present invention to provide a pump, as above, which significantly reduces the potential for a water hammer effect on the quantity of the pumped fluid.

These and other objects of the present invention, as well as the advantages thereof over existing prior-art pumps, which will become apparent from the description to follow, are accomplished by the improvements hereinafter described and claimed.

In general, a pump made in accordance with one aspect of the present invention includes a pump body having a fluid inlet and a fluid outlet. A first valve is positioned in the fluid inlet, and a second valve is positioned in the fluid outlet. A connector having a bend is formed at the fluid inlet. When the pump is activated, fluid is drawn in around the bend, through the inlet and first valve, into the pump body, and fluid passes out through the second valve and the fluid outlet.

In accordance with another aspect of the present invention, the pump includes a chamber. A fluid inlet is positioned laterally to one side of the chamber, and a fluid outlet is positioned laterally to the other side of the chamber. The fluid inlet and outlet communicate with the chamber above the centerline of the fluid inlet and fluid outlet. When the pump is activated, fluid is received through the inlet, into the chamber, and fluid passes out through the outlet.

A preferred exemplary pump incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 2:
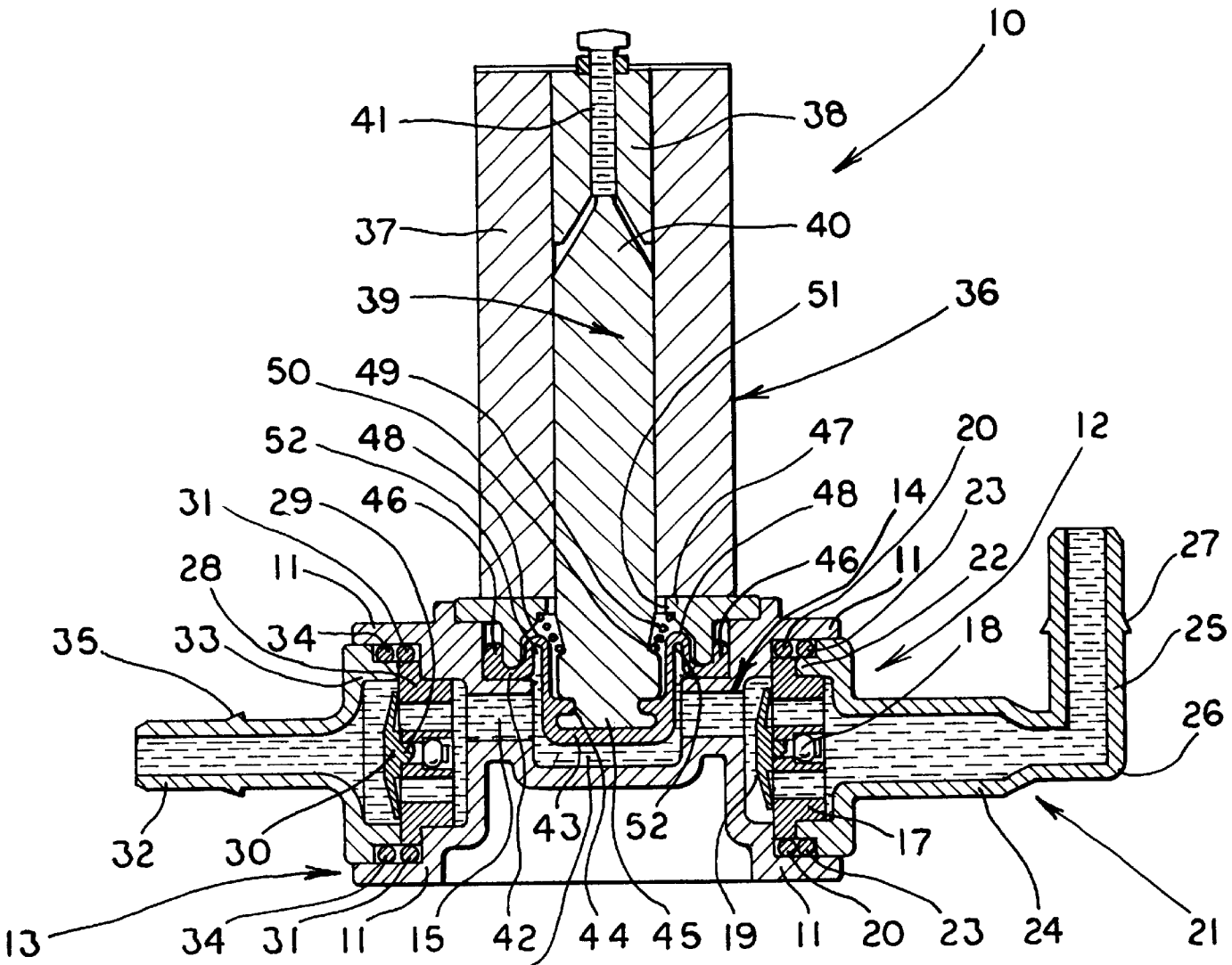
FIG. 2 is a sectional view similar to FIG. 1 but showing the pump in an energized condition.

A pump made in accordance with the concepts of the present invention is indicated generally by the numeral 10. The pump 10 shown in the drawings is generally known in the art as a metering pump wherein it is desirable that a precise, usually small, amount of fluid may be repeatedly dispensed therefrom. Pump 10 includes a housing or body portion 11 which defines a fluid inlet area generally indicated by the numeral 12, a fluid outlet area generally indicated by the numeral 13, and a chamber generally indicated by the numeral 14 and positioned laterally between the fluid inlet area 12 and the fluid outlet area 13. Specifically, chamber 14 includes side portions 15 and a lower portion 16 (FIG. 2). Side portions 15 are in fluid communication with each other by lower portion 16, and side portions 15 are in fluid communication with fluid inlet area 12 and fluid outlet area 13. As will be more fully hereinafter discussed, it is important to one aspect of the present invention that side portions 15 are located above the centerline of fluid inlet 12 and fluid outlet 13.

Fluid inlet area 12 includes a valve seat assembly 17 which carries the valve stem 18 of an umbrella valve 19. An o-ring seal 20 is positioned between valve seat 17 and housing 11. Fluid is provided to valve 19 via a connector generally indicated by the numeral 21. Connector 21 includes an annular flange 22 positioned at inlet area 12 with an o-ring 23 providing the seal between flange 22 and housing 11. Connector 21 also includes a generally horizontal tube 24 extending outwardly at one end from flange 22 and housing 11. Tube 24 may be attached to housing 11 by a spring retainer clip (not shown). The other end of tube 24 is fluidly connected to a generally vertically oriented tube 25 thereby forming a bend or elbow 26. Vertical tube 25 may be provided with one or more barbs 27 so that a hose or the like may attach tube 25 to a source of supply of fluid. As will hereinafter be discussed in more detail, elbow 26 absorbs the force of the inlet fluid which might otherwise cause the deleterious water hammer effect. In addition, it is not critical that tube 25 be vertically oriented. Rather, it is only important that there be some angle between tubes 24 and 25, forming a bend 26, with it being preferable that the bend be ninety degrees in any direction, not necessarily vertical, of tube 24.

Fluid outlet area 13 is horizontally aligned with fluid inlet area 12 and includes a valve seat assembly 28 which carries the valve stem 29 of an umbrella valve 30. An o-ring seal 31 is positioned between valve seat 28 and housing 11. Fluid passing through outlet valve 30 is provided to a generally horizontally oriented connector tube 32 which includes a flange 33 positioned within outlet area 13. Tube 32 may be attached to housing 11 by a spring retainer clip (not shown). An o-ring 34 provides a seal between flange 33 and housing 11. Tube 32 may be provided with one or more barbs 35 so that a hose or the like may be attached to tube 32 to direct the fluid being pumped to its proper destination.

Pump 10 is actuated by an activation assembly generally indicated by the numeral 36. The specific nature of activation assembly 36 is not important to the present invention, and it can, therefore, be any system which, upon actuation, will result in the metering of one quantity of fluid out of pump 10. The activation assembly 36 somewhat schematically shown in the drawings includes a solenoid 37 which, when energized, magnetizes a core 38 to move a plunger or piston generally indicated by the numeral 39.

Plunger 39 has a nose 40 formed at one end which is adapted to engage a calibration screw 41 which extends through core 38. The position of screw 41 thus determines the extent of the movement of plunger 39 which controls the volume of fluid being pumped upon each actuation of solenoid 37.

The other end of plunger 39 carries a diaphragm generally indicated by the numeral 42. Diaphragm 42 is a conventional elastomeric member having a lower portion 43 which is received within pump chamber 14 and divides chamber 14 into its opposed side portions 15. Lower portion 43 includes a lip 44 which engages a flange 45 on the end of plunger 39 such that plunger 39 thereby carries diaphragm 42. The ends 46 of diaphragm 42 are maintained against housing 11 by a diaphragm retainer plate 47 which is held in place on housing 11 by a spring retainer clip or the like (not shown). A convolution 48 is formed in diaphragm 42 between lower portion 43 and the ends 46 being engaged by plate 47, which convolution travels upward when solenoid 37 is actuated (compare FIGS. 1 and 2). A return spring 49 is positioned between a shoulder 50 formed near the end of plunger 39 and a shoulder 51 formed on retainer plate 47.

Figure 1:
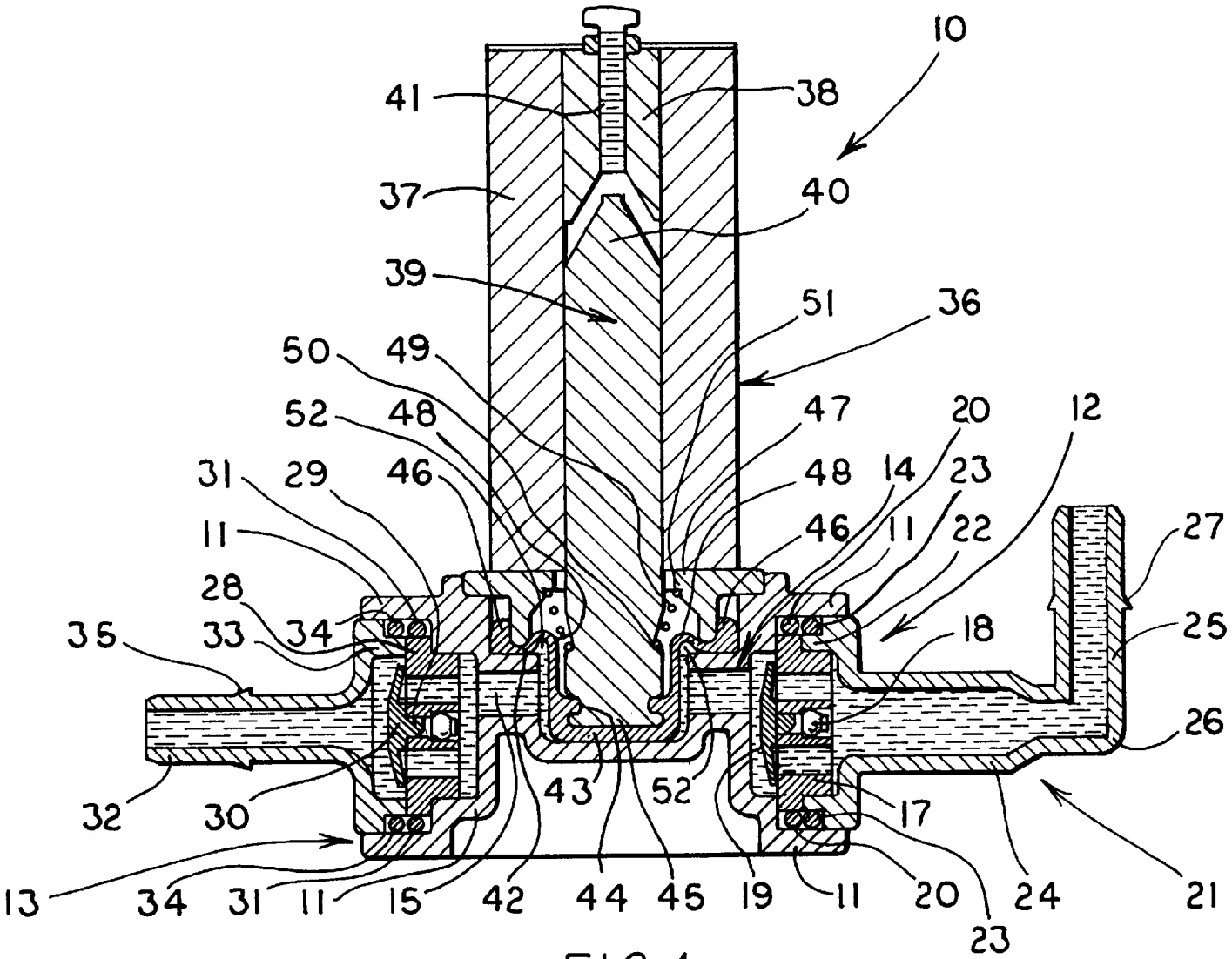
FIG. 1 is a sectional view of a pump made in accordance with the present invention and shown in a de-energized condition.

The components of pump 10 are shown in their deactivated position in FIG. 1. Because of the orientation of portions 15 of chamber 14 relative to fluid inlet 12 and fluid outlet 13, that is, because, as previously described, portions 15 are positioned at a high level relative to inlet 12 and outlet 13, and specifically above the centerline thereof, the formation of air bubbles 52 is at a minimum. In fact, in the configuration of FIG. 1, only very tiny air bubbles 52 may be permitted to form in the dead space just below convolutions 48.

Upon activation of solenoid 37, plunger 39 is drawn upwardly, as shown in FIG. 2, until its nose 40 engages calibration screw 41. Diaphragm 42 thus moves against the bias of spring 49 to draw a metered amount of fluid into chamber 14. Specifically, the quantity of fluid drawn in is defined by the volume of lower portion 16 of chamber 14, that is, the space below portion 43 of diaphragm 42. As shown in FIG. 2, it will be observed that the dead air space below convolution 48 has moved up when the convolution moved up with any air bubbles 52 which may be positioned therein rising within that dead air space. As such, the air bubbles 52 constitute a very small volume compared to the size of chamber 14 and only minimally affect the accuracy or repeatability of any stroke of pump 10.

It should also be appreciated that when pump 10 moves from the FIG. 1 to the FIG. 2 position, fluid travels down tube 25 and hits or otherwise encounters elbow 26 where it is caused to turn into horizontal tube 24. Such action all but eliminates any potential water hammer as the energy of the moving fluid is absorbed by the elbow 26. The inlet fluid then passes through valve 19 and, as previously described, the increased volume of fluid in pump 10 fills chamber portion 16. However, the instantaneous return of pump 10 from the FIG. 2 to the FIG. 1 condition, caused by the action of return spring 49 after solenoid 37 has been de-energized, causes the precise amount of fluid to be discharged through valve 30 and into tube 32.

If the bend in the inlet tubing, shown as elbow 26, had not thwarted the water hammer effect, upon actuation of solenoid 37, it would have been highly likely that more fluid than desired, in an uncontrolled and nonrepeatable manner, would have passed through valve 19 with its momentum placing pressure on and opening outlet valve 30, resulting in inaccuracies in the amount of fluid being pumped. Moreover, the extent of such inaccuracy would not be consistent, thereby rendering the problem uncorrectable, but for the pressure absorption of elbow bend 26.

It should also be pointed out that while elbow 26 could be located very close to inlet area 12, it is preferably spaced therefrom by a distance defined by the length of tube 24. Ideally, the elbow or bend which absorbs the momentum of the flowing fluid should be about one inch away from the inlet valve. This distance affects the flow rate of the fluid, and the further the elbow is away from the inlet area, the more flow is achieved. Such increased flow will allow for a more controlled volume with the same stroke of solenoid plunger 39.

In light of the foregoing, it should thus be evident that a pump constructed in accordance with the concepts of the present invention, as described herein, accomplishes the objects of the present invention and otherwise substantially improves the art.

What is claimed is:

1. A pump comprising a pump body having a chamber, a fluid inlet in said pump body positioned laterally to one side of said chamber, a fluid outlet in said pump body positioned laterally to the other side of said chamber, said fluid inlet and said fluid outlet communicating with said chamber, a first valve at said fluid inlet, a second valve at said fluid outlet, a connector formed at said fluid inlet, said connector having a bend, and a plunger carrying a diaphragm positioned at least partially in said chamber such that upon movement of said plunger fluid is drawn around said bend, through said first valve, into said chamber, and out through said second valve, said diaphragm including convolutions defining the only dead air space in the pump.

2. The pump according to claim 1 wherein said first valve and said second valve are horizontally aligned with each other.

3. The pump according to claim 2 said first and second valves having a centerline and said chamber being positioned to one side of said centerline of said first valve and said second valve.

4. The pump according to claim 3 wherein said plunger is on said one side of said centerline.

5. The pump according to claim 4 wherein said plunger is movable by a solenoid.

6. The pump according to claim 5 further comprising calibration means to control the extent of the movement of said plunger.

7. The pump according to claim 1 wherein said connector includes a generally horizontal tube having one end connected to said fluid inlet and the other end carrying said bend thereby spacing said bend from said fluid inlet.

8. The pump according to claim 7 wherein said connector includes a generally vertical tube having one end connected to said bend.

9. A pump comprising a chamber, a fluid inlet having a centerline and being positioned laterally to one side of said chamber, a fluid outlet having a centerline and being positioned laterally to the other side of said chamber, said fluid inlet and fluid outlet communicating with said chamber not on the centerline of said fluid inlet and said fluid outlet, and a plunger carrying a diaphragm positioned at least partially in said chamber such that upon movement of said plunger fluid is received through said fluid inlet, into said chamber, and through said fluid outlet, said diaphragm including convolutions defining the only dead air space in the pump.

10. The pump according to claim 9 further comprising a solenoid which is actuated to move said plunger to draw fluid into said chamber and to increase the size of said convolutions.

11. The pump according to claim 10 further comprising a calibration device to limit the movement of said plunger to thereby control the amount of fluid received in said chamber.

12. The pump according to claim 10 further comprising a return spring to move said plunger when said solenoid is deactivated.

13. The pump according to claim 9 further comprising a first tube having one end connected to said fluid inlet and a second tube connected to said first tube at an angle relative to said first tube.

14. The pump according to claim 13 wherein said first tube is generally horizontally oriented and said second tube is generally vertically oriented to form an elbow between said first and second tubes.

* * * * *